United States Patent [19]

Miller

[11] Patent Number: 4,714,414

[45] Date of Patent: Dec. 22, 1987

[54] PLURAL-STAGE GAS COMPRESSOR

[75] Inventor: Bernard F. Miller, Corning, N.Y.

[73] Assignee: Ingersoll-Rand Company, Woodcliff Lake, N.J.

[21] Appl. No.: 911,795

[22] Filed: Sep. 26, 1986

[51] Int. Cl.[4] ..... F04C 18/356; F04C 23/00; F04C 29/02; F04C 29/04

[52] U.S. Cl. ..... 418/11; 418/60; 418/63; 418/83; 418/99

[58] Field of Search ..... 418/5, 9–13, 418/83, 99, 210, 60, 63

[56] References Cited

U.S. PATENT DOCUMENTS

| | | | |
|---|---|---|---|
| 2,699,726 | 1/1955 | Quinn | 418/9 |
| 3,077,867 | 2/1963 | Froede | 418/210 |
| 3,111,820 | 11/1963 | Atchison | 418/99 |
| 3,682,566 | 8/1972 | Nakamura | 418/11 |
| 4,174,195 | 11/1979 | Lassota | 418/83 |

FOREIGN PATENT DOCUMENTS

| | | | |
|---|---|---|---|
| 58-122393 | 7/1983 | Japan | 418/83 |
| 10187 | of 1895 | United Kingdom | 418/11 |

*Primary Examiner*—John J. Vrablik
*Attorney, Agent, or Firm*—B. J. Murphy

[57] ABSTRACT

The compressor comprises four stages of compression. It has four compression chambers within four, separate compartments removably bolted to a central, supporting, gear housing. In the compression chambers are rotary (rolling) pistons. A pair of parallel, gear-driven shafts journalled in the housing have eccentric pins on ends thereof. The pins intrude into the chambers and rotatably carry the rotary pistons thereon. Conduits traverse the compartments to inject water into the chambers for cooling, sealing, and lubrication of the rotary pistons. Too, the compartments conduct compressed gas therethrough from the compression chambers, and conduct coolant therethrough as well to heat exchange with the compressed gas product.

7 Claims, 4 Drawing Figures

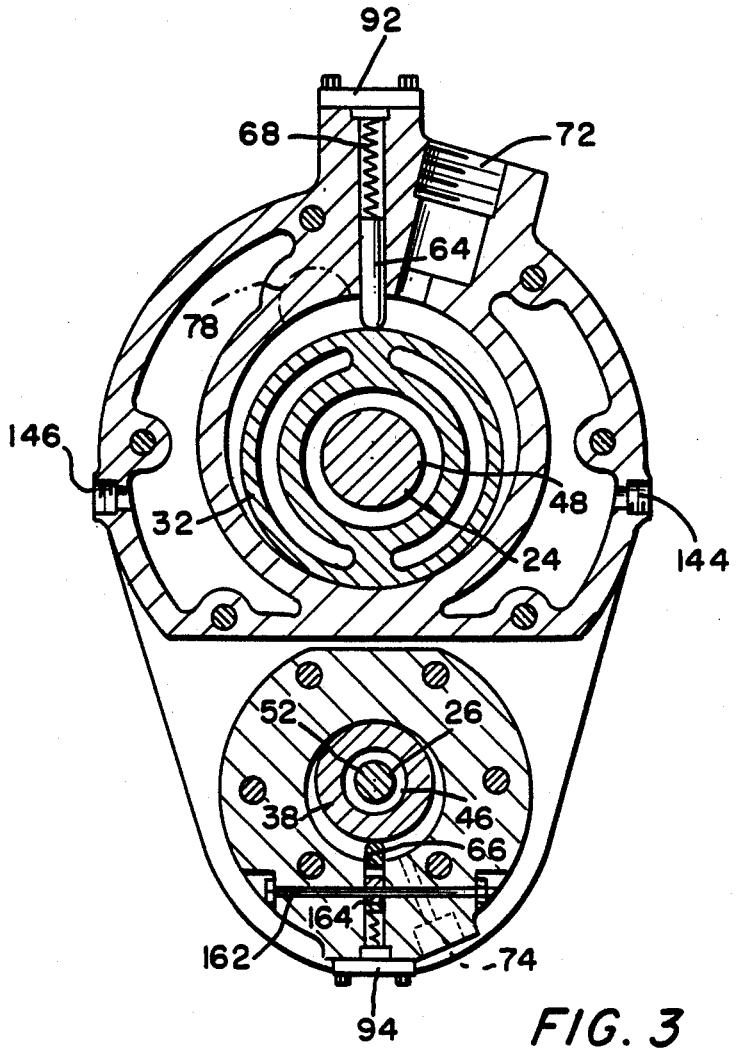
FIG. 3
FIG. 3A
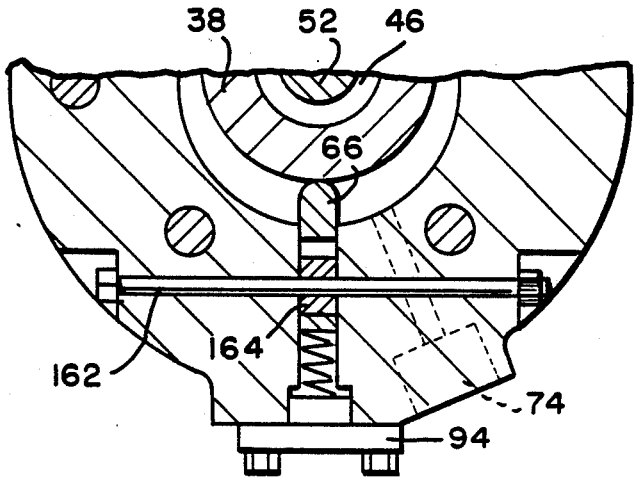

PLURAL-STAGE GAS COMPRESSOR

This invention pertains to rotary gas compressors, and in particular to high speed, rotary, gas compressors for providing oil-free air or other gases at pressures up to five thousand psig.

Most high speed, rotary, gas compressors are designed for low pressure applications (100 psi or less). Most high pressure, gas compressors are reciprocating, multi-stage, and large, heavy, slow speed units with high, unbalanced forces and moments.

What has long been sought is a high-speed, high-pressure, gas compressor of such design and arrangement as to be substantially balanced and capable of a most facile maintenance, disassembly or repair.

It is an object of this invention, then, to provide just such an aforesaid gas compressor.

Particularly it is an object of this invention to set forth a plural-stage gas compressor, comprising: a gear housing; said housing having (a) a pair of spaced-apart, parallel, side walls, and (b) a gear chamber formed therewithin; a driving gear rotatably confined within said chamber; a primary, driven gear interpositioned between said walls, and in meshed, driven engagement with said driving gear; a secondary, driven gear interpositioned between said walls, and in meshed, driven engagement with said primary, driven gear; a primary shaft (a) coupled to said primary gear for rotation therewith, and (b) journalled in said walls rotatably supporting said primary gear in said chamber on a rotary axis; and a secondary shaft (a) coupled to said secondary gear for rotation therewith, and (b) journalled in said walls, rotatably supporting said secondary gear in said chamber on a rotary axis; wherein each of said shafts has integral pins, on opposite ends thereof, eccentric to, albeit parallel with, said rotary axis of its associated shaft; and said pins of each said shaft are parallel to each other, albeit having eccentricities which, in this embodiment, dispose them one hundred and eighty degrees of arc apart from each other relative to said rotary axis of their associated shaft; further including separate compartments, defining gas compression chambers therewithin, replaceably fixed to external surfaces of said walls; wherein each of said compression chambers has a rotary piston confined therein; and each of said pins has one of said rotary pistons journalled thereon.

It is a feature of this invention to disclose a unique air compressor designed specifically for, but not limited to, shipboard application. The same is a high speed, small, compact, lightweight and oil-free air compressor completely lubricated by water, with no condensate drain system required to remove water between stages (as required in reciprocating machines). The compressor pumps air or other gases up to five thousand psig in four stages of compression.

Further objects and features of this invention will become more apparent by reference to the following description taken in conjunction with the accompanying figures in which:

FIG. 3 is a cross-section view taken along section 3—3 of FIG. 1; and

FIG. 3A is an enlarged detail of the FIG. 3 view.

Figure 1:
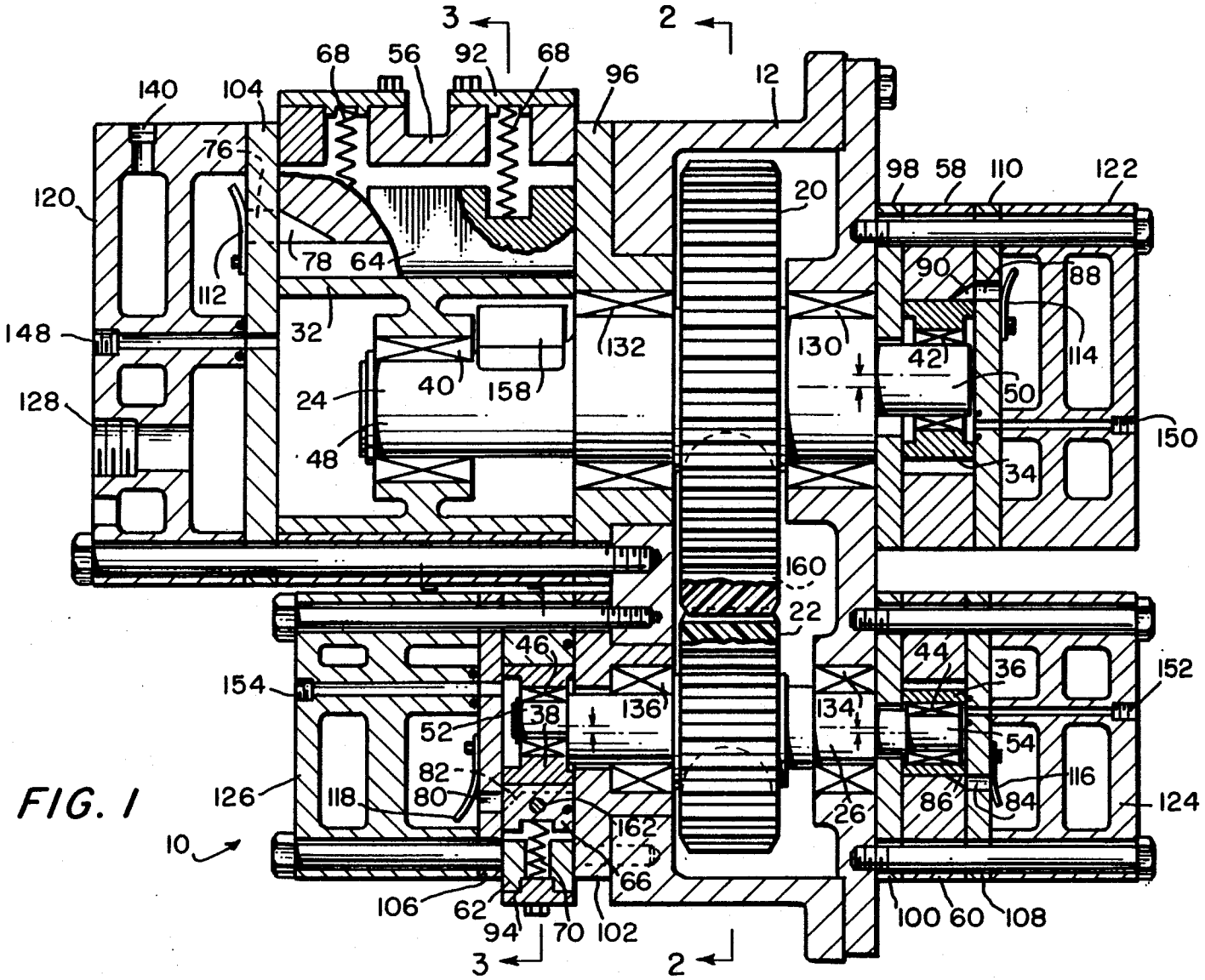
FIG. 1 is a cross-sectional view of an embodiment of the invention taken along section 1—1 of FIG. 2.
Figure 2:
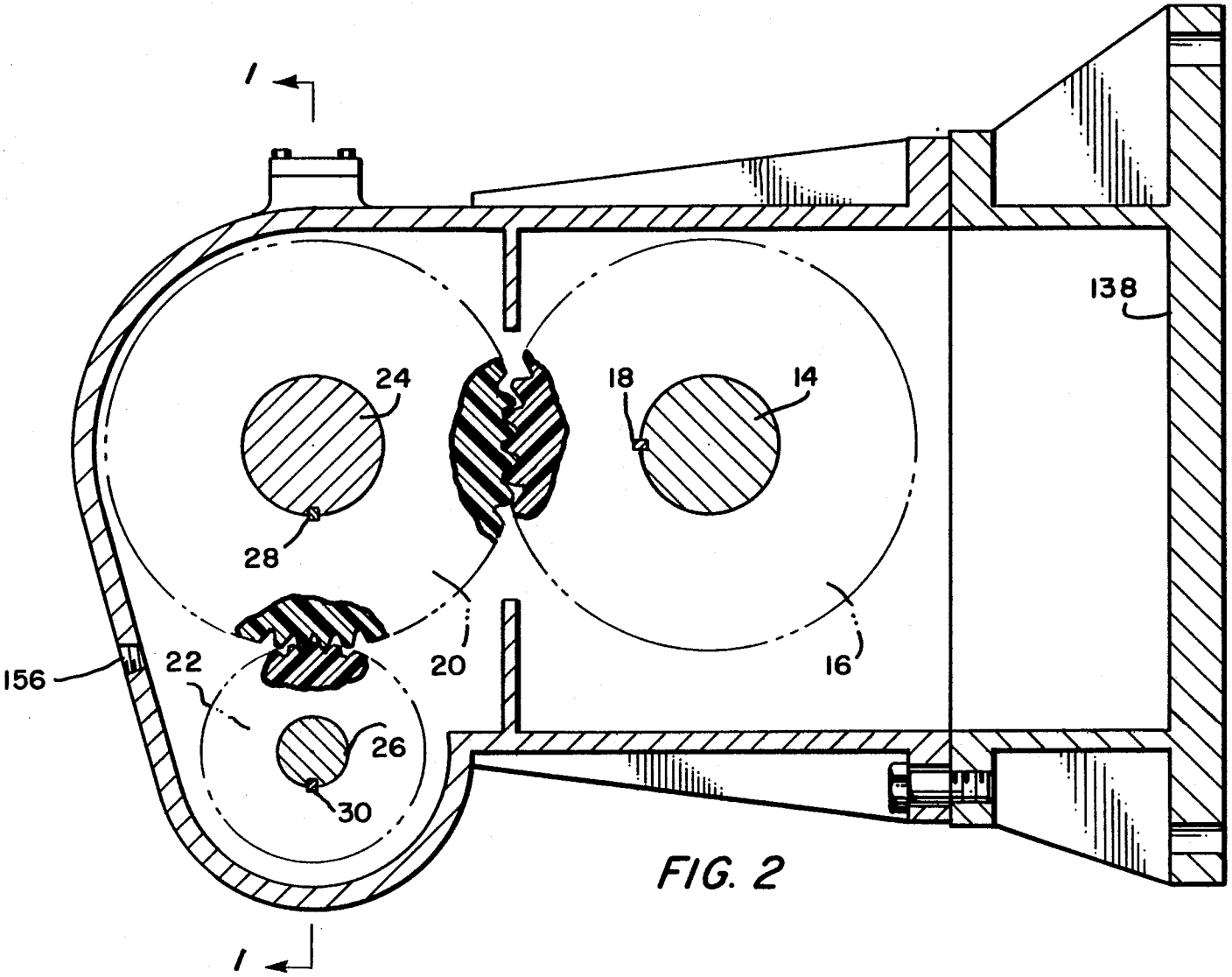
FIG. 2 is a cross-sectional view taken along section 2—2 of FIG. 1.

As shown in the figures, the novel compressor 10, according to an embodiment thereof, comprises a gear housing 12 confining a drive shaft 14 which has a drive gear 16 pressed thereon with a drive key 18. Two driven gears 20 and 22 are sized for different speed ratios between high-pressure and low-pressure-stage sets of cylinders for flexibility of performance.

These gears 20 and 22 are pressed on driven, primary and secondary shafts 24 and 26 and located with keys 28 and 30. The gears 20 and 22 are made of a non-metallic, phenolic or other plastic or composite materials for low noise transmission (but can be made of metallic materials or a combination thereof).

Pistons 32, 34, 36, and 38 and anti-friction bearings 40, 42, 44 and 46, which are lubricated with water, are assembled on primary and secondary shafts 24 and 26, respectively, on pins 48, 50, 52, and 54 that are eccentric to the main shafts. The eccentricity is one hundred and eighty degrees of arc apart, on the two pins of each shaft, for balance purposes (for this embodiment of the invention).

The pistons 32, 34, 36, and 38 rotate within cylinders, formed within external, removable compartments, of varying diameters and lengths for each stage. These cylinders 56, 58, 60, and 62 have their centers located on the true centers of the primary and secondary shafts 24 and 26. The compartments each contain a sliding vane, 64 or 66 which is typical of each cylinder, and a spring, 68, 70 to maintain pressure of the vane(s) on the rolling piston(s).

Suction connections 72 and 74 are typical for each cylinder and discharge ports and port reliefs 76, 78, 80, 82, 84, 86, 88, and 90 are formed in each cylinder. Caps 92 and 94 allow insertion or removal of the sliding vanes 64, 66 and springs 68, 70 and are typical for each sstage. Plates 96, 98, 100, 102, 104, 106, 108, and 110 are smoothly ground and form the sides or end plates of their respective cylinders. Reed valves 112, 114, 116, and 118 allow the compressed gas to exhaust from the cylinders. The gas then flows the outer heads 120, 122, 124, and 126 through discharge connection, such as outlet 128, in outer head 120, which is typical of each stage.

The primary and secondary shafts 24 and 26 rotate in water-lubricated swing pad bearings 130, 132, 134, and 136. As the shafts 24 and 26 are driven in opposite directions, the pistons 32, 34, 36, and 38 rotate and the eccentric motion takes in gas on one side of the vane where is compressed and released through the discharge ports 76, 78, etc., on the other side of the vanes 64, 66, etc. Gas flows through the heads to the discharge port at discharge pressure.

Cooling is provided by means of water-to-water heat exchangers (not shown) built into base 138 with a pump (not shown) but mounted on or in base. Cooling water is pumped by the pump via an external piping system (not shown) to each outer head to an inlet 140 and from each outer head via an outlet 142, the same being typical for each cylinder.

Also, the first stage cylinder 56 is cooled by water through inlet and outlet connections 144 and 146. Water is injected through ports 148, 150, 152, and 154 through an atomizer (not shown) into the cylindrical or rolling pistons and piston bearings 40, 42, 44, and 46 for lubrication in a mist form. This water provides cooling for heat of compression and sealing for the ends of pistons. A mist of water is also injected into cylinder at the gas inlet ports 72, 74, etc., for lubrication between outer surfaces of the pistons, vanes and cylinder walls.

Water is also injected into shaft bearings 130, 132, 134, and 136 for lubrication and cooling. Water in free form is injected via a port 156 into the gear housing 12 to lubricate and cool the gears 16, 20, and 22. All water is returned by gravity to the base sump 138 where it is cooled by the exchangers (not shown). Any condensate formed by the compression cycle is also used for lubrication, and is returned to the sump 138 eliminating the need for a condensate drain system between stages or makeup water for the closed cooling water system.

The injected water also provides sound dampening for all moving parts. Rusting is prevented by using stainless steel fabrication of components, especially for shipboard application. Balancing is accomplished by opposed pistons and counterweights such as 158 on the shaft and 160 on the gear. Other counterweighting can be provided in the gear case on either side of gears. Other types of valves can also be used, and timing gears can also be used to eliminate valves.

Vane 66, in the third stage of compression, has a tie bolt 162 fixed therethrough via a slidable web 164 carried by the vane 66. This same arrangement is proposed to be used in the fourth stage, and perhaps also in the second stage of compression, if wanted or desired, however, this tie bolt arrangement is shown only in connection with vane 66 by way of example.

While I have described my invention in connection with a specific embodiment thereof, it is to be clearly understood that this is done only by way of example and not as a limitation to the scope of my invention, as set forth in the objects thereof and in the appended claims.

I claim:

1. A plural-stage gas compressor, comprising:

a gear housing;

said housing having (a) a pair of spaced-apart, parallel, side walls, and (b) a gear chamber formed therewithin;

a driving gear rotatably confined within said chamber;

a primary, driven gear interpositioned between said walls, and in meshed, driven engagement with said driving gear;

a secondary, driven gear interpositioned between said walls, and in meshed, driven engagement with said primary, driven gear;

a primary shaft (a) coupled to said primary gear for rotation therewith, and (b) journalled in said walls rotatably supporting said primary gear in said chamber on a rotary axis; and a secondary shaft (a) coupled to said secondary gear for rotation therewith, and (b) journalled in said walls, rotatably supporting said secondary gear in said chamber, on a rotary axis; wherein each of said shafts has integral pins, on opposite ends thereof, eccentric to, albeit parallel with, said rotary axis of its associated shaft; and said pins of each said shaft are parallel to each other, albeit having eccentricities which dispose them at a given angular distance apart from each other, relative to said rotary axis of their associated shaft; further including separate compartments, defining gas compression chambers therewithin, replaceably fixed to external surfaces of said walls; wherein each of said compartments has (a) a circumferential wall and a gas inlet port formed in said circumferential wall for admitting gas therethrough, radially, into said compression chamber of said compartment, and (b) an outer, end plate, at an outermost, axial end, and in closure, of said compression chamber;

each of said end plates has a gas outlet port formed therein for admitting gas therethrough, axially, from said compression chamber associated therewith; and including an outer, removable header coupled to, and parallel with, each of said end plates; wherein each of said headers has means therewithin subdividing said header into a plurality of galleries;

one of said galleries have valving means therewithin for controlling a conduct of gas through said outlet port from an associated gas compression chamber;

another of said galleries comprises means for cooling said one gallery;

said cooling means comprises means for conducting coolant through said another gallery;

each of said headers comprises means in traverse of end plat and said header, and isolated from fluid communication with said galleries, for injecting coolant, axially, into its associated gas compression chamber;

each of said compression chambers has a rotary piston confined therein; and each of said pins has one of said rotary pistons journalled thereon.

2. A gas compressor, according to claim 1, wherein:

said compression chambers have centerlines which are collinear with said rotary axes of said shafts.

3. A gas compressor, according to claim 1, wherein:

one of said walls has a pair of said compartments removably bolted thereto in spaced apart relationship; and the other of said walls has a pair of said compartments removably bolted thereto in spaced apart relationship.

4. A gas compressor, according to claim 1, wherein:

each of said compartments has wall means therein cooperative with said pistons for subdividing its respective compression chambers.

5. A gas compressor, according to claim 4, wherein:

each of said compartments has a channel formed therein which is substantially radially disposed relative to said rotary axis of that one of said shafts which is associated therewith; and said wall means of each of said compartments comprises a vane slidably disposed in said channel, and having an end in sealing engagement with such one of said rotary pistons as is confined in said compartment.

6. A gas compressor, according to claim 5, wherein:

said channel has a first end which opens externally of said compartment, and a second, opposite end which opens internally of said compartment and into said compression chamber; and further including means biasing said vane away from said first end.

7. A gas compressor, according to claim 6, further including:

a closure cap, removably fixed across said first end of said channel, for accommodating facile access to said vane and said biasing means.

* * * * *